United States Patent [19]

del Cueto

[11] 3,997,290

[45] Dec. 14, 1976

[54] PROCESS TO SEPARATE AND RECOVER THE SOLID AND LIQUID PHASES FROM TREATMENT BATHS OF HIDES AND SKINS

[76] Inventor: Eusebio del Cueto, Grieta No. 165, Mexico City 20, Mexico

[22] Filed: Apr. 21, 1975

[21] Appl. No.: 569,642

[30] Foreign Application Priority Data

May 6, 1974 Mexico ..... 151060

[52] U.S. Cl. ..... 8/94.16; 8/94.15; 8/94.17

[51] Int. Cl.[2] ..... C14C 1/06; C14C 1/08

[58] Field of Search ..... 8/94.16, 94.15, 94.17

[56] References Cited

UNITED STATES PATENTS

| | | | |
|---|---|---|---|
| 2,516,806 | 7/1950 | Schneider | 8/94.15 |
| 3,194,865 | 7/1965 | Fagan et al. | 264/209 |
| 3,741,722 | 6/1973 | Elvrum | 8/94.16 |

*Primary Examiner*—John Kight, III

*Attorney, Agent, or Firm*—Ladas, Parry, Von Gehr, Goldsmith & Deschamps

[57] ABSTRACT

The present invention provides a process to separate and recover the solid and liquid phases from treatment baths of hides and skins. The solid phase contains valuable components used in a variety of industries providing a wide field of industrial applications. The liquid phase or treatment bath from hides and skins is practically used in indefinite forms to treat hides and skins and to prepare them for further tanning or preservation.

Practically no part of the treatment bath from hides and skins is wasted, and this involves a great saving of water and chemical agents such as salts, bases and acids that take part in the preparation of hides and skins. Besides, the environment is not contaminated as these harmful waste waters are not disposed of and gases, such as hydrosulfuric acid, can be recuperated.

9 Claims, No Drawings

PROCESS TO SEPARATE AND RECOVER THE SOLID AND LIQUID PHASES FROM TREATMENT BATHS OF HIDES AND SKINS

BACKGROUND OF THE INVENTION

The preparation of hides and skins for tanning or preservation is an art-science that has taken place many years ago and it can be said to be the oldest of industries. In ancient times man used to cover his body with hides and skins which he elementarily prepared by skinning animals and fleshing the skins with primitive instruments. Man soon learned to salt skins to make them contract and give them an adequate consistency for wearing.

As time passed, preparation, tanning and softening technics for hides and skins got more perfected, basically by chemical means and better processes as well as more efficient equipment and control methods that made involved operations in said art-science much easier.

At present, different technics for preparing hides and skins for tanning and further preservation are used, based fundamentally in treating hides and skins with salt or chemical agents such as calcium hydroxide and sodium sulphide, getting more or less satisfactory results. Nevertheless, present processes are comparatively expensive if it is taken into consideration that chemical agents used for preparing hides and skins, once used, are thrown away, which involves environmental contamination, particularly sewages and consequently water currents in which chemical and organic waste residues are carried.

Previous problems have made it necessary to provide an economical and efficient process that do not contaminate the environment, and the process of the present invention surprisingly solves such problems.

Now, it has been discovered that preparation of hides and skins in adequate conditions, produce recoverable solid values that can be used in different industries such as fertilizers feeding, pharmaceutical and biochemical industries and others, due to the excelent properties of such solid values which find a wide field of industrial application.

Besides, the solid values recovered from hides and skins through the process provided by the present invention, chemical agents are saved as treatment baths from hides and skins are practically used indefinitely with a very small expense of chemical agents. In consequence, environmental contamination is eliminated and gases, such as sulphydric acid are recuperated.

SUMMARY OF THE INVENTION

An object of the present invention is to provide a process to separate and recover the solid and liquid phases from treatment baths of hides and skins in order to take advantage of the solid phase for different industries, while the liquid phase is used again in the subsequent treatments to which hides and skins are subjected. Through the process of the present invention hides and skins are prepared for their tanning or preservation.

Complementing the object mentioned above, there is the saving of chemical agents in the liquid phase, once the solid phase has been separated, for the liquid phase can be used again to depilate, tan or preserve hides and skins without an additional excessive expense in reagents.

Another further object of the invention is the recovery of gases produced by the different operations of the process.

Another object of the invention is the reduction of water consumption and reagents such as salts, acids or bases and at the same time the elimination of environmental contamination of air as well as of waste residual liquids.

The above mentioned objects and other further objects of the invention will be clearly described in the present description.

In order to closely examine the economical value of the process which is the object of the invention, it will be convenient to specify the economical value of the liquid phase as well as of the solid phase. It has already been said that the liquid phase is an aqueous solution of salts, acids or bases which can be employed again in the treatment of hides and skins, eventually after the addition of complementary amounts of chemical agents, thus obtaining a great saving.

In relation to the solid phase from the hides and skins treatment, it can be said that it is mainly composed of proteins, lipids and carbohydrates and of complex colloidal systems resulting from their combination or of the same with the chemical agents used in the treatment of hides and skins. The solid phase is perticularly composed by such substances as collagens, mucins, keratins, melanins, carbohydrates, lipids, (i.e. fats, stearines, tallow) phospholipids, cholesterols, etc.

The process of the invention comprises the following steps:

a. From hides and skins in differenct conditions, practically in any state, such as hides or skins with hair, salted, dried, flint dry or fresh (i.e. recently flayed). Hides and skins are placed in contact with an aqueous salt solution for soaking and conditioning, the salt is selected from the group consisting of a halide and an anhydrous or hydrated metal sulphate and its mixtures;

b. To the saline solution containing the hides and skins an amount of a strong alkali is added, such as sodium hydroxide, potassium hydroxide, a mixture of calcium hydroxide and sodium sulphide, or mixtures, in different ratios, of said chemical agents to continue the conditioning of hides and skins. The alkaline solution containing the hides and skins is stirred within specific limits of alkalinity and temperature;

c. After stirring the previous system for a determined period of time, hair looses and is separated by sieving;

d. The treatment bath of hides and skins is separated;

e. The bath is treated, with stirring, with an acid, preferably a strong acid, selected from the group consisting of hydrochloric acid and sulphuric acid although acid salts, such as sodium or potassium acid sulphate, can be used. The pH decreases occurring a precipitation, therefore the system contains a precipitated solid phase;

f. The liquid and solid phases are separated by decantation, filtration, centrifugation or combination of these operations, adjusting the solid phase to the desired conditions, for their further use in other industry;

g. The clarified liquid phase is recovered by treating it with an alkali such as sodium or potassium hydroxide or with calcium hydroxide and sodium sulphide or their mixtures adjusting it to an adequate pH, concentration and temperatures;

h. The liquid phase adjusted according with the previous step, is used to place it in contact with hides and skins and continue their conditioning.

The sequence of previous operations is repeated the necessary number of times, adjusting the conditions as desired in each step, to obtain an efficient separation of the solid and liquid phases, particularly by the complete precipitation of the solid phase.

In each of the process steps as described, different factors are involved, in order to perform with precise effectiveness said process. Thus, for example, in step a) a volume of aqueous salt solution from 10 to 1000% can be used with regard to the weight of hide or skin. The salt concentration can be maintained between 4 – 25%, the temperature can be from 5° to 50° C, the density of the solution varies between 0.5° Be and 40° Be, the pH can be kept between 4 and 14 and stirring of the salt solution containing the hides and skins is performed at a speed that varies from 1 to 30 rpm and the time of contact is from a few minutes to several days.

On the other hand, the precipitation in step e) is performed by decreasing the pH to a value of from 2 to 5.

The recovery of the liquid phase with an alkali according to g) is made adjusting the pH to a value of from 4 to 14, the concentration of alkali is adjusted to from 0 to 20% and the temperature is kept between 10° C and 25° C.

The selection of factors and variables that are involved in each of the steps of the described process, will depend from hides or skins used and their state, from the disponibility of equipment and raw materials and very fundamentally from the type of hides or skins wished to be obtained. It is important to take note that through the described process, hides and skins are conditioned for their tanning or preservation.

The following are some important factors that should be considered for the performance of the present invention: HIDES AND SKINS. The hide or skin is a very large and important biological organ. It is a complex structural combination of proteins, lipides, carbohydrates, salts and water. This tridimensional fibrous tissue is composed of several tissues, glands, mainly of fibrous and globular proteic substances, albumins, globulins, mucins, melanins, keratins, elastins, reticulin, collagen, lipides, their combinations, glycerides, waxes, phospholipides, sterols, fatty acids, carbohydrates and combinations, enzymes, vitamins, mineral constituents, water.

It would be too large to give all of the constituents and their possible forms of such a complex biological and delicate organ which we just call hide or skin, and which is the raw stock to be prepared and transformed into leather.

At any rate a distincition needs to be made regarding the terms hide and skin. Hide is used for large animals as for cows (i.e. cowhide) whereas for small animals the term conventionally used is skin (i.e. calfskin). THE LIQUID PHASE The liquid phase can be considered as a vehicle, a fluid vehicle, a sort of "solvent". It is, mainly, an aqueous salt solution. It is used taking into account the kind of salt, the volume to be used, the pressure or concentration, the pH, acidity or alkalinity, the temperature, and possible other variables, such as activity, diffusivity, surface tension and viscosity.

The main aqueous salt solution or liquid phase consists of an aqueous solution of sodium chloride, sodium sulphate, potassium chloride, potassium sulphate, or mixtures of these salts, at the determined physico-chemical conditions of volume, pressure (density, concentration, osmotic pressure, solution pressure), temperature and pH.

The pH, acidity or alkalinity of this aqueous salt solution or liquid phase can be modified at will by the use of acids, such as HCl, $H_2SO_4$, or bases such as NaOH, KOH, or mixtures of these reagents.

If a sodium chloride aqueous solution is prepared, it is wished to modify its pH, acidity or alkalinity, and then still have a neutral sodium chloride solution, we use NaOH and HCl. If we have a sodium sulphate solution, for the same purpose, we use $H_2SO_4$ and NaOH. The same applies to potassium salts or bases.

When in proper contact with the hides or skins, this liquid vehicle acts in several ways, physically and chemically, conditioning, attacking the hides or skins and its components, so as to prepare them for its tanning or preservation, and as a solvent for the substances extracted from the hides or skins. THE SOLID PHASE. What we consider the solid phase is a mixture of substances which, by the treatment of the hides or skins by means of the liquid phase, were attacked, dissolved and extracted from the hides or skins. It is composed mainly of proteins, lipides, carbohydrates, their combinations and their complex collodial systems resulting from the attack of the solutions used in the treatment of hides or skins. It is obvious that this so-called solid phase is a very important by-product which can be recovered and will find interesting use for other chemical, medical and biochemical industries.

The attack, dissolution and extraction can be done in parts or totally, and can be controlled by the proper application of the physico-chemical factors and proper methods of separation, recovery and adjustment, to suit the requirement of the possible eventual users of this solid phase. THE FACTORS. The physico-chemical factors that intervene for the proper application of the ideas in order to form an operative and controlled process which will obtain the required effects of preparation of hides or skins for tanning or preservation with the recovery of the baths of treatment of hides or skins for the proper separation, adjustment and re-use, are the following: WEIGHT. The weight of hides or skins is considered taking into account the conditions of said raw stock, that is to say, if it is fresh or cured, fleshed, splitted, trimmed, its size, thickness and past history. The available equipment in which the hides or skins are to be treated, its form, dimensions, materials of construction, form of agitation and speed, also the structure of vats, paddles, drums, modern hide processors or sophisticated new recipients for the proper mixing or contact of the hides or skins with the bath of treatment, are important for determining the weight of the hides or skins to be used in the process. VOLUME. This factor is closely related to the weight and conditions of the hides and skins. With the volume of the saline solution in contact with the hides or skins, a system if formed in which several phenomena of diffusion, imbibition, swelling, attack and physical and chemical effects take place. This factor is closely related to the other factors and to the mechanical work produced on the hides or skins by the agitation, stirring or mixing. The proportion of volume in relation to the weight will depend on the effects produced, which will depend on the equipment and the conditions of the hides or skins and the final characteristics of the leather to be obtained.

The volume of saline solution, liquid phase or bath to be placed in contact with a weight of hides or skins might go from a paint or daub applied to the hides or skins or from about 10 to 2000%.

For treatment in vats or paddle, a volume of 400 to 800% is usual.

For conventional drum work, from 100 to 300%.

For modern hide processors, 50 to 200%. PRESSURE. Solution pressure, osmotic pressure, density or concentration. This is a very important factor, since the proper pressure or concentration of the salt solution to be used in the treatment of hides or skins is of paramount importance for the control and obtention of the required effects.

The main salt solution for the treatment of hides or skins can be adjusted to the most appropriate degree of pressure or saline concentration depending on the effects to be produce on the hides or skins and its contituents.

The pressure of the solution is obtained by dissolving a weight of salt in a volume of water. The most economical salts for this purpose are the alkaline halides or sulphates such as NaCl, $Na_2SO_4$, although other salts can be used, as KCl, $K_2SO_4$, and their mixtures. The pressure factor is also related to the other factors.

Besides the physical effects of the pressure on the fibrous structure and components of hides or skins, there are other effects, such as solvent effect, salting-in and salting-out effects, lyotropic effects, to be taken into account.

The pressure of solution can vary from about 0.8° Be to 25° Be or more, depending on the solubility of the salts used, temperature and other factors.

This pressure factor serves also for the control of swelling phenomena in relation to the alkalinity or acidity of the bath of treatment. The pH of the solution and of the aqueous system with the hides or skins can be controlled in a wide range of values.

The use of saline solutions instead of water permits an easy recovery, adjustment and re-use of the saline solution again and again, for the treatment of hides or skins and their preparation for tanning or preservation. TEMPERATURE. Temperature, when dealing with delicate biological organs such as hides or skins, is a very important factor, and its influence on the other factors is clear.

The process can be reduced to practice at ambient temperature, but any temperature, within safe limits can be used. For certain particular cases, it might be convenient to work at the lowest possible temperatures; for other cases, at the highest possible ones.

From 0° C to 50° C is a wide range of temperature for any particular case. 15° C to 20° C is a usual temperature for treating hides or skins. TIME. Time of treatment of the hides or skins and of the baths of treatment in view of the recovery of the solid and liquid phases, is a factor of wide variation, depending on the equipment available and of the other factors.

Since the effects to be obtained in the hides or skins for the proper preparation for tanning or preservation are dependent of the combination of several other factors, the time factor is closely related to all and every one of the other factors.

The time conditions for the treatment of hides or skins and the necessary time for the separation, recovery and adjustment of the baths of treatment can vary from a few minutes, to several hours or some days, depending on the available equipment and working conditions, and the conditions of the raw stock. AGITATION. In order to obtain an efficient contact of the hides or skins and the bath of treatment, agitation systems must be carefully adapted to obtain the optimum contact or mixing and not to damage the hides or skins. In short baths, control of temperature is very important, since due to agitation it might rise to dangerous degrees. The agitation of the baths of treatment, when separated from the hides or skins must also be properly applied to obtain the best results.

For drum or hide processors, the r.p.m. might vary from 1 to 30, although 2 rpm to 8 rpm are usual for the conditioning of the hides and skins.

Several other ways of agitation can be used, such as compressed air, vibrations, manual, etc.

Agitation during a certain time and then a period of rest is usual in the treatment of hides and skins. pH. ALKALINITY, ACIDITY. The aqueous saline solution or liquid phase, as well as the hides or skins, and the solid phase, can be adjusted to the desired or convenient pH, alkalinity or acidity, using HCl or $H_2SO_4$ as the acids of NaOH or KOH as the bases.

If the saline solution is prepared with NaCl and water, pH, alkalinity and acidity can be adjusted with HCl and NaOH, and when convenient, a neutral NaCl solution can be easily obtained. The same applies to a $Na_2SO_4$ and water solution, it can be adjusted with $H_2SO_4$ and NaOH, and the same for potassium salts solutions.

The pH of the first conditioning of hides or skins with the salt solution can be from pH 5.0 to pH 10.0.

The alkalinity in the step of unhairing and high alkaline treatment might be of from 1% NaOH to 6% NaOH in the system.

The pH for separation of the solid and liquid phases might be of pH 2.0 to pH 6.0. MODE OF OPERATION. There are many ways of placing in contact the hides or skins with the baths of treatment and of separation of the baths of treatment from the hides or skins.

The hides or skins can be placed in the drum or hide processor and the bath of treatment can be added gradually or all at once, or part of the bath of treatment can be added at first, agitating, and after a time, the rest of the volume. The salt solution can be added first, at a pH of 5 to 10, and then, a base added gradually or all at once, to reach the calculated degree of alkalinity of the system.

The total bath of treatment is in the vat or paddle and the hides or skins added.

The separation of the bath of treatment from the hides or skins can be done by gravity, pumping, draining suction or by removing the hides or skins from the vats.

The separation of the liquid and solid phases from the bath of treatment of hides or skins can be done, once separated from the hides or skins, by treatment with acids, acids and salts, adjusting the pH to the proper degree, all with the purpose of obtaining a good precipitation of the solid phase.

The mechanical separation of the solid and liquid phases can be done by decantation, filtration, screening, centrifugation or combination of these opeations.

In order to obtain a clear and complete understanding of the invention according to the foregoing, the following examples are included, but they only constitute specific technics, experimentally developed, and do not limit the invention.

EXAMPLE 1

100 kg. of fresh, fleshed and trimmed hides are placed in a drum.

200 lts. of a $Na_2SO_4$ solution, at 15° Be, 18° C, pH 6.8, are added to the drum, and agitation is started at 2 rpm.

After 2 hours of agitation, the bath of treatment is separated from the hides, and placed in a tank. The hides remain in the drum.

In 40 lts. of the bath of treatment, 12 kg. of 50% NaOH are dissolved. Temperature adjusted to 18° C. The drum started at 2 rpm. The alkalin-saline bath is added. Agitation continued for 1 hour. Rest during 2 hours. Start the drum and agitate 5 minutes every hour for 16 hours. Add the rest of the neutral saline bath of treatment, and agitate at 6 rpm for 1 hour.

The bath of treatment is separated from the hides. The hides are scudded and place back into the drum. During this operation, the bath of treatment, in a tank with stirring device and a device for recovery of gases, is treated with $H_2SO_4$ until pH of 3.0 is reached. The solid and liquid phases are separated by filtration. The solid phase is kept. The liquid phase is adjusted to pH 8.0, with NaOH, to 12° Be, with water or $Na_2SO_4$ (if necessary), and 18° C.

The adjusted liquid phase is added to the hides, the drum started, and agitated at 2 rpm for 2 hours. After this time, the same operation is performed, except the scudding of hides, which are left in the drum. Once the liquid phase is adjusted again to the same physico-chemical conditions, it is added back to the hides, the drum started and agitation for 2 hours. After this time, the same operation is repeated.

This operation is repeated until the hides are conditioned, by the proper modification of the physico-chemical conditions of concentration and pH, to the adequate condition to be placed in contact with the tanning systems.

The final liquid phase is kept for the next lot of hides to be prepared, after its proper adjustment, as explained.

The hides thus prepared can be tanned or pickled for preservation, in the usual ways.

EXAMPLE 2

100 kg. of green salted hides are placed in a drum.

200 lts. of a NaCl solution, at 8° Be, 18° C, pH 7.0, are added to the drum, and agitation is started at 2 rpm.

After 5 hours of agitation and 30 minutes rest every hours, the bath of treatment is separated from the hides, placed into a tank. The hides are fleshed and returned to the drum.

20 kg. of 50% NaOH solution are dissolved in the bath of treatment, adjusting temperature to 15° C, and this alkaline solution is slowly added to the hides in the drum, while the drum is rotating at 6 rpm. After 1 hour of agitation the drum is stopped. Rest for 1 hour. Agitation 5 minutes every hour for 20 hours. If the hair is easily removed, the bath of treatment is separated from the hides. If necessry, the hides are scudded. If unhairing is not easy, more time or more NaOH is added.

The bath of treatment is adjusted to pH 3.5 with HCl, stirring, and gasses recovered by the "washing bottle" system. Liquid and solid phases are separated, filtered, keeping the solid phase, and adjusting the liquid phase to pH 8.0 with NaOH, temperature to 15° C, pressure or concentration to 14° Be, and added back to the hides in the drum, agitate for 2 hours. Except scudding, repeat the same treatment.

Once the hides show a pH of 9.0–9.5, they are separated from the bath of treatment. The solid and liquid separation is made as before. The liquid phase adjusted to the proper physical and chemical conditions to obtain a neutral sodium chloride solution at 8° Be, 18° C, pH 7.0, and kept for the next lot of hides.

The hides are adjusted to the proper pH and saline concentration for the desired method of tanning.

EXAMPLE 3

94 kgs. of bovine hides are place in a 100% w/w of 10% NaCl solution. The whole is stirred for 1 hour at a speed of 3 rpm. After this period, measures taken from the solution give the following readings: a pH of 6, a temperature of 17° C, an alkanlinity of 0% and a density of 16.5° Be. Hides are separated from the solution and fleshed to eliminate all undesirable residues. Then hides are weighted giving a weight of 90.5 kgs. They are then placed in the solution and stirred for 10 more minutes at a speed of 8 rpm. Then the whole is allowed to settle for 1½ hours. Measures taken from the solution after this period give the following readings: a pH of 7.5, a temperature of 18° C, an alkanlinity of 0% and a density of 17° Be. Hides are again stirred in te solution for 10 more minutes at 8 rpm, and then 8.8% w/w of 50% NaOH solution and 16% w/w of cold water are added to the solution and the whole is again stirred for 1 hour at a speed of 8 rpm. After this period the following measures are obtained from the solution: a pH of 13.5, a temperature of 20° C, an alkalinity of 2.4%, and a density of 17° Be. The whole is then allowed to settle for 50 minutes and then 2.2% w/w of 50% NaOH solution is added to the bath solution and the whole stirred for 30 minutes at 8 rpm. It is allowed to settle for 30 minutes and stirred again for 30 minutes at 8 rpm. Then the following measures are obtained from the solution: a pH of 13.8 and a temperature of 21° C. The whole is allowed to settle for 11 hours and measures taken from the solution give a pH of 13.5, a temperature of 18° C, an alkalinity of 1.5%, and a density of 18° Be. The whole is stirred again for 10 minutes at 8 rpm and allowed to settle for 70 minutes. 16.5% w/w of water is then added to the solution and stirred again for 20 minutes at 8 rpm, and then 4.9% w/w of 50% NaOH solution and 16.5% w/w water are added to the solution and stirred again for 15 minutes at 8 rpm. It is then allowed to settle for 45 minutes and stirred again for 15 minutes at 8 rpm. The solution is decanted (due to the fact that filtration can not take place). 195% w/w of 16% NaCl solution is added to the hides and the whole is stirred again for 20 minutes at 8 rpm, after which time the following measures are obtained: a pH of 13, a temperature of 21° C and a density of 12° Be. The solution is decanted. Hides are scudded and weighed, giving a weight of 132 kgs. A 149% w/w of 16% NaCl solution and hides are placed in the bath. The whole is stirred for 40 minutes at 3 rpm. The following measures are obtained from the solution: a pH of 12.5 and a density of 12° Be. The solution is decanted. A 140% w/w of 16% NaCl solution is added and the whole is stirred for 30 minutes at 8 rpm. Measures taken after this addition give a pH of 12. The solution is decanted. A 140% w/w of 16% NaCl solution and 0.26% w/w of 35% hydrochloric acid is added and the whole is stirred for 15 minutes at 3 rpm. Measures taken from the solution give a pH of 10.5. 0.13% w/w of 35% hydrochloric acid is added. The whole is stirred for 10 minutes at 3 rpm. Measures taken from the solution give a pH of 10. Then the solution is decanted. 7.5% w/w of 33% basisity chromosal BM and water to adjust to 20°

Be are added. The whole is stirred for 20 minutes at 8 rpm. 7.5% w/w of 33% basisity chromosal BM, 0.19% w/w of 35% hydrochloric acid and water to adjust to 20° Be are added. The whole is stirred for 3 hours at 8 rpm. Measures taken after wards from the solution give a pH of 5, a temperature of 25° C and a density of 16.5° Be. The whole is allowed to settle for 2 hours and then stirred for 10 minutes. Hides are then separated from the solution and allowed to settle.

EXAMPLE 4

74 kgs. of goat skin are placed in a 400% w/w of 12% NaCl solution and stirred for 5½ hours, after which time measures are taken from the solution that give a pH of 7, a temperature of 19° C and a density of 11.5° Be. The skin is then weighed having a weight of 73 kgs. The skin is placed again in the solution and 20.5% w/w of 50% NaCl solution is added to the bath solution. Then the following measures are obtained from the solution: a pH of 13.8, a temperature of 20.5° C, an alkalinity of 2.7% and a density of 15° Be. Then the whole is stirred for 1 hour and new measures taken from the solution that give an alkalinity of 1.5%. It is stirred again for 1 hour and measures from the solution give an alkalinity of 1.48%. 6.2% w/w of 50% NaOH solution is added to the bath solution and stirred for 10 minutes. Measures taken from the solution give a pH of 14, a temperature of 18° C and a density of 15° Be. Stirring is continued for 15 hours. Measures are taken again from the solution giving a pH of 13.5, a temperature of 17° C, an alkalinity of 1.45% and a density of 15° Be. The whole was allowed to settle for 1½ hours. 2.7% w/w of 50% NaOh solution was added to the bath solution and stirred for 4 hours. New measures taken from the solution give a pH of 13.8, a temperature of 16° C and a density of 15° Be. The whole was allowed to settle for 90 minutes and then stirred for 5 minutes. Measures taken from the solution give an alkalinity of 1.96%. It was allowed to settle for 75 minutes. Stirred again for 5 minutes. Measures taken from the solution give a pH of 13.8, a temperature of 17° C and a density of 15° Be. It was stirred for 1 hour. Allowed to settle for 15½ hours. Stirred again for 10 minutes. New measures from the solution give a pH of 13.8, a temperature of 16° C, an alkalinity of 1.9% and a density of 15° Be. The whole was allowed to settle for 2½ hours. It was stirred for 1 hour, fleshed and stacked. Skins are weighed giving a weight of 60 kgs. The bath solution is adjusted to a pH of 10. Skins are placed in the bath and stirred for 1 hour. It is allowed to settle for 15 hours. Measures taken from the solution give a pH of 13, a temperature of 19° C, an alkalinity of 0.14% and a density of 11° Be. The bath solution is again adjusted to a pH of 8. The whole is stirred for 5½ hours. Allowed to settle for 10 hours. Then, measures taken from the solution give a pH of 9, a temperature of 17° C, and a density of 13° Be. Skins are weighed giving a weight of 60 kgs. 25% w/w of 33% basisity cromolin, 13% w/w of water and 0.5% w/w of 35% hydrochloric acid are placed in the bath with the skins and stirred in the drum at 8 rpm for 2 hours and at 3 rpm for 1½ hours. Skins are separated from the bath, stacked and allowed to settle for 48 hours.

EXAMPLE 5

67 kgs. of bovine hide are placed in a bath solution consisting of 450% w/w of 12% NaCl solution. The whole is stirred with paddles for 4½ hours. Measures taken from the solution give a pH of 7, a temperature of 17° C and a density of 10° Be. Hides are separated from the bath and fleshed. Then they are weighed giving a weight of 100 kg. 22.4% w/w of 50% NaOH solution is added to the bath solution. It is stirred for 6½ hours. Measures are taken from the solution at this point giving the following data: first hour: an alkalinity of 2.34%, second hour: an alkalinity of 1.71%, third hour: an alkalinity of 1.59% and sixth hour: an alkalinity of 1.28%. 6% w/w of 50% NaOH solution is added to the bath solution. It is stirred for 10 minutes. Measures taken from the solution give the following data: a pH of 14, a temperature of 18° C and a density of 13° Be. It is stirred again for 20½ hours, measures taken from the solution give a pH of 13.8, a temperature of 17° C, an alkalinity of 1.16%, and a density of 13° Be. It is allowed to settle for 1½ hours. 2 % w/w of 50% NaOH solution is added to the bath solution. It is stirred for 4½ hours. Measures taken from the bath solution give a pH of 13, a temperature of 16° C, an alkalinity of 1.56% and a density of 13.5%. It is allowed to settle for 75 minutes. Then it is stirred for 8 hours, and measures taken from the bath solution give a pH of 13.8, a temperature of 17° C and a density of 13° Be. It is stirred for 1 hour, then it is allowed to settle for 15½ hours. Stirred for 10 minutes. New measures taken from the bath solution at this point give a pH of 13.8, a temperature of 16° C, an alkalinity of 1.77% and a density of 13° Be. It is allowed to settle for 2½ hours, and stirred for 1½ hours. 4.5% w/w of 50% NaOH solution is added to the solution and it is stirred for 20 minutes. New measures taken from the solution give a pH of 13.8, a temperature of 17° C and a density of 13° Be. It is stirred for 5 hours. Hides are sccuded, the bath solution is adjusted to a pH of 7.5. Hides are placed in the bath and the whole is stirred for 1 hour. It is then allowed to settle for 15 hours and new measures taken from the solution give a pH of 12.5, a temperature of 18° C, an alkalinity of 0.07% and a density of 13° Be. The bath solution is adjusted to a pH of 7.3. Hides are placed again in the bath solution and the whole is stirred for 5½ hours. Then it is allowed to settle for 16 hours, stirred for 10 minutes and new measures taken from the solution give a pH of 9, a temperature of 17° C and a density of 13° Be. It is stirred again for 3½ hours and then allowed to settle for 1 hour. Then, hides and the bath solution are placed in the drum and 20% w/w of 33% basisity cromolin, 0.4% w/w of industrial sulphuric acid and water to adjust the mixture to 20° Be are added. It is stirred for 3 hours at 8 rpm. Then it is allowed to rest for 42 hours, and stirred again for 1 hour. Hides are then separated from the bath and stacked. The final pH is 2.8 and the boiling assay is positive.

EXAMPLE 6

94 kgs. of bovine hide are placed in a bath consisting of 350% w/w of a NaCl solution at 10° Be. Then the whole is stirred for 4 hours, allowed to rest for 48 hours, stirred for 90 minutes and allowed to rest for 1½ hours. Then the hides are fleshed and weighed giving a weight of 92 kgs. Hides are placed in the bath solution and 22.8% w/w of 50% NaOH solution is added to the bath, stirred 45 minutes and measures taken from the solution at this point give a pH of 13.8, a temperature of 20° C and a density of 15° Be. It is stirred again for 4½ hours, measures taken from the solution give an alkalinity of 1.32%. 11.4% w/w of 50% NaOH solution is added and then stirred for 10 minutes. New measures taken from the solution give a pH of 14, a temperature of 20° C and a density of 15° Be. It is again stirred for 2 hours, allowed to rest for 14 hours and stirred again for 10 minutes. New measures taken from the solution give a pH of 14, a temperature of 18° C and a density of 13.5° Be. It is stirred for 1 1/4, then measures taken from the solution give a pH of 10, a temperature of 17° C, an alkalinity of 3.2% and a density of 13° Be. It is stirred for 35 minutes, then it is allowed to settle for 24 hours. Hides are scudded. Then the bath solution is adjusted to a pH of 7. Hides are weighed giving a weight of 128 kgs. The bath is stirred for 1 hour. Then it is allowed to settle for 15 hours, stirred again for 5 minutes. New measures taken from the solution give a pH of 11.5, a temperature of 18° C, an alkalinity of 0.98 and a density of 13° Be. It is allowed to settle for 1 hour, then the solution is adjusted to a pH of 9. Hides are placed in the bath solution and stirred for 3 hours, allowed to settle for 17 hours and then stirred for 1 hour. Following, the system (hide and bath solution) is placed in the drum and 25% w/w of 33% basisity cromolin, 10% w/w water and 0.4% w/w industrial sulphuric acid are added, and stirred for 3 hours at 8 rpm. It is allowed to settle for 20 hous. Finally, hides are separated from the bath and stacked.

EXAMPLE 7

88 kgs. of bovine hides are placed in a bath solution consisting of 300% w/w of NaCl solution at 12° Be, and allowed to settle for 24 hours. Then hides are fleshed and weighed giving a weight of 101 kgs. Hides are placed in the bath solution and 28.8% w/w of 50% NaOH solution are added and the whole is stirred for 30 minutes. Measures are then taken and the following data is obtained: a pH of 13.8, a temperature of 20.5° C and a density of 15° Be. The whole is then stirred for 7 hours, and measures taken from the solution at this point give the following data: first hour: an alkalinity of 2.99%, second hour: an alkalinity of 2.5% and third hour: an alkalinity of 2.3%. The whole is allowed to settle for 12 hours and then stirred for 4½ hours. Again it is allowed to settle for 15 minutes. Then hides are scudded. The bath solution is adjusted to a pH of 9. Hides are weighed giving a weight of 116 kgs. Hides are then placed in the bath and stirred for 4 hours in a drum. 25% w/w of 33% basisity cromolin, 0.4% w/w of industrial sulphuric acid and 10% w/w water are added to the bath solution and the whole is stirred for 3½ hours at 8 rpm. 6% w/w of 33% basisity cromolin is added to the bath solution and stirred again for 1 hour at 14 rpm. Then hides are separated from the bath solution and stacked.

EXAMPLE 8

104 kgs. of bovine hide are placed in a bath solution consisting of 400% w/w of NaCl solution at 12° Be and allowed to settle for 24 hours. Then hides are fleshed and weighed giving a weight of 104 kgs. 32% w/w of 50% NaOH solution is added to the bath solution and it is stirred for 1 hour with paddles. Measures are taken from the solution and the following data is obtained: a pH of 13.8, a temperature of 20° C, an alkalinity of 2.93% and a density of 15° Be. It is stirred for 13½ hours and then allowed to settle for 1 hour. New measures give a pH of 13.8, a temperature of 18.5° C, an alkalinity of 1.1% and a density of 13° Be. Hides are scudded. Then they are allowed to settle in the bath for 15 hours. The bath solution is adjusted to a pH of 9. Weighing the hides again they give a weight of 153 kgs. The whole is stirred for 4 hours, and 25% w/w of 33% basisity cromalin, 10% w/w water, 0.4% w/w industrial sulphuric acid and 0.5% w/w NaCl are added to the bath solution, and it is stirred again for 3 hours at 8 rpm. Then hides are separated from the bath and stacked.

I claim:

1. A process for separating and recovering the solid and liquid phases from the baths of treatment of hides and skins in any conditions, i.e. with hair, crude salted, dry, flint-dry or fresh recently flayed, which comprises the steps of:

a. contacting the hides and skins with an aqueous salt solution, in order to wet and condition them, using as the salt, a compound selected from an halide and a metal sulphate, anhydrous or hydrated, and mixtures thereof, agitating the salt solution containing the hides and skins, during a period of time of from a few minutes to several days;

b. adding to the salt solution that contains the hides and skins, a strong alkali such as an alkaline metal hydroxide or a mixture of an alkali-earth metal hydroxide and an alkaline sulphide, while maintaining the agitation in the system, whereby the hides and skins continue their conditioning and the components adhered to the hides and skins are attacked;

c. if necessary, screening the bath for separating the hair that may be released from the hides and skins;

d. separating from the treatment bath, the hides and skins once the conditioning thereof has ended;

e. treating the bath while agitating, with a strong acid or with an acid salt, for lowering the pH until a value of 2 to 5, whereby a precipitation of the solid phase released from the hides and skins occurs;

f. separating the solid precipitated phase from the liquid phase;

g. treating the liquid phase with a strong alkali such as an alkali metal hydroxide or with a mixture of an alkali metal hydroxide and an alkaline sulphide to raise the pH to a value of 6 to 14, whilst a temperature of 0° C. to 50° C. is maintained, and h. utilizing the liquid phase adjusted according to g), for the conditioning of the hides and skins for their further treatment at a pH of from 6 to 14.

2. A process for separating and recovering the solid and liquid phases from the baths of treatment of hides and skins according to claim 1 a), wherein the volume of water is of 10 to 2000% with respect to the weight of the hides and skins.

3. A process for separating and recovering the solid and liquid phases from the baths of treatment of hides and skins according to claim 1 a), wherein the salt is sodium chloride, anhydrous or hydrated sodium or potassium sulphate and mixtures thereof.

4. A process for separating and recovering the solid and liquid phases from the baths of treatment of hides and skins according to claim 1 a), wherein the salt concentration is from 0.5° to 40° Be.

5. A process for separating and recovering the solid and liquid phases from the baths of treatment of hides and skins according to claim 1 a), wherein the temperature is from 5° to 50° C.

6. A process for separating and recovering the solid and liquid phases from the baths of treatment of hides and skins according to claim 1 b), wherein the strong alkali which is added to the salt solution or initial treatment bath of the hides and skins, is selected from the group consisting of sodium hydroxide, potassium hydroxide, a mixture of calcium hydroxide and sodium sulphide and mixtures thereof.

7. A process for separating and recovering the solid and liquid phases from the baths of treatment of hides and skins according to claim 1 e), wherein the strong acid is selected from hydrochloric acid and sulphuric acid.

8. A process for separating and recovering the solid and liquid phases from the baths of treatment of hides and skins according to claim 1 e), wherein the acid salt is selected from sodium bisulphate and potassium bisulphate.

9. A process for separating and recovering the solid and liquid phases from the baths of treatment of hides and skins according to claim 1 e), wherein gases that generate, are recovered by the washing bottle method.

* * * * *